US007838297B2

(12) United States Patent
Widmer et al.

(10) Patent No.: US 7,838,297 B2
(45) Date of Patent: Nov. 23, 2010

(54) COMBUSTION OPTIMIZATION FOR FOSSIL FUEL FIRED BOILERS

(75) Inventors: Neil Colin Widmer, San Clemente, CA (US); Roy Payne, Mission Viejo, CA (US); William Randall Seeker, San Clemente, CA (US); Philippe Jean Gauthier, Fullerton, CA (US)

(73) Assignee: General Electric Company, Schenectady, NY (US)

( * ) Notice: Subject to any disclaimer, the term of this patent is extended or adjusted under 35 U.S.C. 154(b) by 748 days.

(21) Appl. No.: 10/249,298

(22) Filed: Mar. 28, 2003

(65) Prior Publication Data

US 2004/0191914 A1 Sep. 30, 2004

(51) Int. Cl.
*G01N 33/00* (2006.01)

(52) U.S. Cl. ..... 436/55; 702/1; 702/22; 702/23; 702/24; 702/30

(58) Field of Classification Search ..... 700/1, 700/17, 28, 31, 32, 274; 702/1, 22, 23, 24, 702/30, 31; 110/185, 186, 187, 188, 189, 110/190; 431/1, 12, 75, 76
See application file for complete search history.

(56) References Cited

U.S. PATENT DOCUMENTS

| | | | | |
|---|---|---|---|---|
| 3,722,811 | A | 3/1973 | Osburn | |
| 3,734,675 | A | 5/1973 | Osburn | |
| 4,223,615 | A | 9/1980 | Breen et al. | |
| 4,353,206 | A | 10/1982 | Lee | |
| 4,559,785 | A | 12/1985 | Gaines et al. | |
| 4,576,570 | A | 3/1986 | Adams et al. | |
| 4,599,975 | A | 7/1986 | Reeve et al. | |
| 4,749,122 | A | 6/1988 | Shriver et al. | |
| 5,042,404 | A | 8/1991 | Booth et al. | |
| 5,159,562 | A | 10/1992 | Putman et al. | |
| 5,305,230 | A | 4/1994 | Matsumoto et al. | |
| 5,546,874 | A | 8/1996 | Breen et al. | |
| 5,568,777 | A | 10/1996 | Breen et al. | |
| 5,655,899 | A | 8/1997 | Hura et al. | |
| 5,694,869 | A | 12/1997 | Breen et al. | |
| 5,713,291 | A | 2/1998 | Mull, Jr. | |
| 5,724,897 | A | 3/1998 | Breen et al. | |
| 5,781,700 | A | 7/1998 | Puskorius et al. | |
| 5,798,946 | A | 8/1998 | Khesin | |
| 5,827,352 | A | 10/1998 | Altman et al. | |
| 5,943,865 | A * | 8/1999 | Cohen | 60/653 |
| 6,145,454 | A | 11/2000 | Barna | |
| 6,169,981 | B1 | 1/2001 | Werbos | |

(Continued)

OTHER PUBLICATIONS

Nakayama, Y., Boucher, R.F.; Introduction to Fluid Mechanics; Butterworth-Heinemann, 2000.

(Continued)

*Primary Examiner*—Sam P Siefke
(74) *Attorney, Agent, or Firm*—Armstrong Teasdale LLP

(57) ABSTRACT

A method of optimizing operation of a fossil fuel fired boiler includes, in an exemplary embodiment, providing a plurality of sensors positioned in different spatial positions within the fossil fuel fired boiler. The method also includes recording sensor outputs, identifying spatial combustion anomalies indicated by sensor outputs, identifying burners responsible for the spatial combustion anomalies, and adjusting air flow of responsible burners to alleviate the spatial combustion anomalies.

21 Claims, 4 Drawing Sheets

U.S. PATENT DOCUMENTS 6,244,200 B1 6/2001 Rabovitser et al.
6,277,268 B1 8/2001 Khesin et al.
6,278,899 B1 8/2001 Piche et al.
6,289,266 B1 9/2001 Payson et al.
6,326,758 B1 12/2001 Discenzo
6,341,519 B1 1/2002 Khesin et al.
6,349,293 B1 2/2002 Yamaguchi
6,360,680 B1 3/2002 Breen et al.
6,381,504 B1 4/2002 Havener et al.
6,389,330 B1 5/2002 Khesin
6,453,830 B1 9/2002 Zauderer
6,468,489 B1 10/2002 Chang et al.
6,775,645 B2 * 8/2004 Daw et al. ..... 702/188
6,804,612 B2 * 10/2004 Chow et al. ..... 702/34
6,901,351 B2 * 5/2005 Daw et al. ..... 702/188

OTHER PUBLICATIONS

Computational Fluid Dynamics, http://en.wikipedia.org, Aug. 29, 2008, pp. 1-8.

* cited by examiner

COMBUSTION OPTIMIZATION FOR FOSSIL FUEL FIRED BOILERS

BACKGROUND OF INVENTION

This invention relates generally to boilers, and more particularly to the optimization of combustion in fossil fuel fired boilers.

In numerous industrial environments, a hydrocarbon fuel is burned in stationary combustors (e.g., boilers or furnaces) to produce heat to raise the temperature of a fluid, e.g., water. For example, the water is heated to generate steam, and this steam is then used to drive turbine generators that output electrical power. Such industrial combustors typically employ an array of many individual burner elements to combust the fuel. In addition, various means of combustion control, such as overfire air, staging air, reburning systems, selective non-catalytic reduction systems, can be employed to enhance combustion conditions and reduce oxides of nitrogen ($NO_x$) emission.

For a combustor to operate efficiently and to produce an acceptably complete combustion that generates byproducts falling within the limits imposed by environmental regulations and design constraints, all individual burners in the combustor must operate cleanly and efficiently and all combustion modification systems must be properly balanced and adjusted. Emissions of $NO_x$, carbon monoxide (CO), mercury (Hg), and/or other byproducts (e.g., unburned carbon or loss-on-ignition (LOI) data) generally are monitored to ensure compliance with environmental regulations and acceptable system operation. The monitoring heretofore has been done, by necessity, on the aggregate emissions from the combustor (i.e., the entire burner array, taken as a whole).

Some emissions, such as the concentration of unburned carbon in fly ash and Hg are difficult to monitor on-line and continuously. In most cases, these emissions are measured on a periodic or occasional basis, by extracting a sample of ash and sending the sample to a laboratory for analysis. When a particular combustion byproduct is found to be produced at unacceptably high concentrations, the combustor is adjusted to restore proper operations. Measurement of the aggregate emissions, or measurement of emissions on a periodic or occasional basis, however, do not provide an indication of what combustor parameters should be changed and/or which combustor zone should be adjusted.

It is known that the air to fuel ratios between each burner in a combustor of a boiler can vary considerably because the burner air and pulverized coal distributions can vary significantly from burner to burner. The absence of effective methods to adequately monitor and control the coal and air flows can contribute to a boiler not operating under its optimal combustion conditions. The variance in burner coal and air flow rates can lead to a wide variance in individual burner operating conditions, some operating on the fuel-rich side and some on the fuel-lean side of the average boiler air to fuel ratio. The burners operating on the fuel-rich side produce significant unburned combustion by-products (CO and LOI) that may not be completely oxidized downstream by mixing with excess air from fuel-lean burners. The degree to which a fuel-rich burners unburned byproducts are oxidized depends on the proximity of fuel-lean burners, the degree of mixing and the mixed burner stream temperature. The final unburned byproduct levels restrict the boiler from operating at lower excess air levels that has the effect of driving fuel-rich burners richer, producing more unburned byproducts as well as reducing the availability of excess air from fuel-lean burners to burn-out byproducts of the fuel-rich burners. The result of these out of balance burner conditions is that boilers must operate at higher excess air levels. The levels of excess air are dictated by the amount of imbalance in the burner's air to fuel ratios. As a result of the operation under high excess air there can be an increase in $NO_x$ emissions and a reduction in the boiler's efficiency which increases operational costs for fuel and $NO_x$ credits and reduces output due to emissions caps.

In some plants, boilers are operated with high excess air in order to increase combustion gas mass flow and subsequent heat transfer in the convective pass to achieve desired steam temperatures. In these applications, burner imbalance can have an impact on gas temperature uniformity. For fossil fuel fired boilers, peak combustion temperatures are reached at slightly fuel-rich operation. These peak temperatures caused by fuel-rich burners can lead to increased metal fatigue, slagging (melted ash) deposits on convective passes, corrosive gases and high ash loadings in local convective pass regions. To remove ash and slagging, additional sootblowing is required. Sootblowing, high temperature gases and corrosive gases lead to deterioration of watertube and waterwall metals resulting in frequent forced outages with lost power generation capability. Currently to avoid catastrophic failure due to high temperature metal fatigue in convective passes, the boiler is derated. This means the boiler is operated below rated capacity which reduces the total heat input and reduces the gas temperature exiting the furnace prior to the convective passes.

SUMMARY OF INVENTION

In one aspect, a method of optimizing operation of a fossil fuel fired boiler is provided. The boiler includes a plurality of burners with each burner receiving fossil fuel and combustion air. The method includes providing a plurality of sensors positioned in different spatial positions within the fossil fuel fired boiler. The method also includes recording sensor outputs, identifying spatial combustion anomalies indicated by sensor outputs, identifying burners responsible for the spatial combustion anomalies, and adjusting air flow of responsible burners to alleviate the spatial combustion anomalies.

In another aspect, a method of optimizing operation of a fossil fuel fired boiler is provided. The boiler includes a plurality of burners with each burner receiving fossil fuel, primary air, and secondary air. The method includes providing a plurality of at least one of LOI sensors and CO sensors positioned in different spatial positions within the fossil fuel fired boiler, balancing burner fuel flow, recording sensor outputs, identifying spatial combustion anomalies indicated by sensor outputs, identifying burners responsible for the spatial combustion anomalies, and adjusting air flow of responsible burners to alleviate the spatial combustion anomalies.

DETAILED DESCRIPTION

A method of optimizing operation of a fossil fuel fired boiler is described below in detail. The method includes the use of a plurality of different sensors in different spatial locations within a particulate fossil fuel fired boiler furnace to track in-furnace combustion conditions and the relative differences between individual burners. The method also includes using the sensor information to make adjustments to individual burners to yield an optimized boiler performance. The optimized operating burner conditions can vary from one burner to another. This means that the air flow and fuel flow can vary from burner to burner and that the air to fuel ratio to individual burners are not predetermined. Rather, each burner is biased and adjusted to meet boiler performance objectives as indicated by the in-furnace sensors. Optimized performance includes, for example, reduced $NO_x$ emissions, reduced LOI emissions, increased efficiency, increased power output, improved superheat temperature profile, and/or reduced opacity. Burner adjustments include, for example, coal and air flow, fuel to air ratio, burner register settings, overfire air flows, and other furnace input settings.

Figure 1:
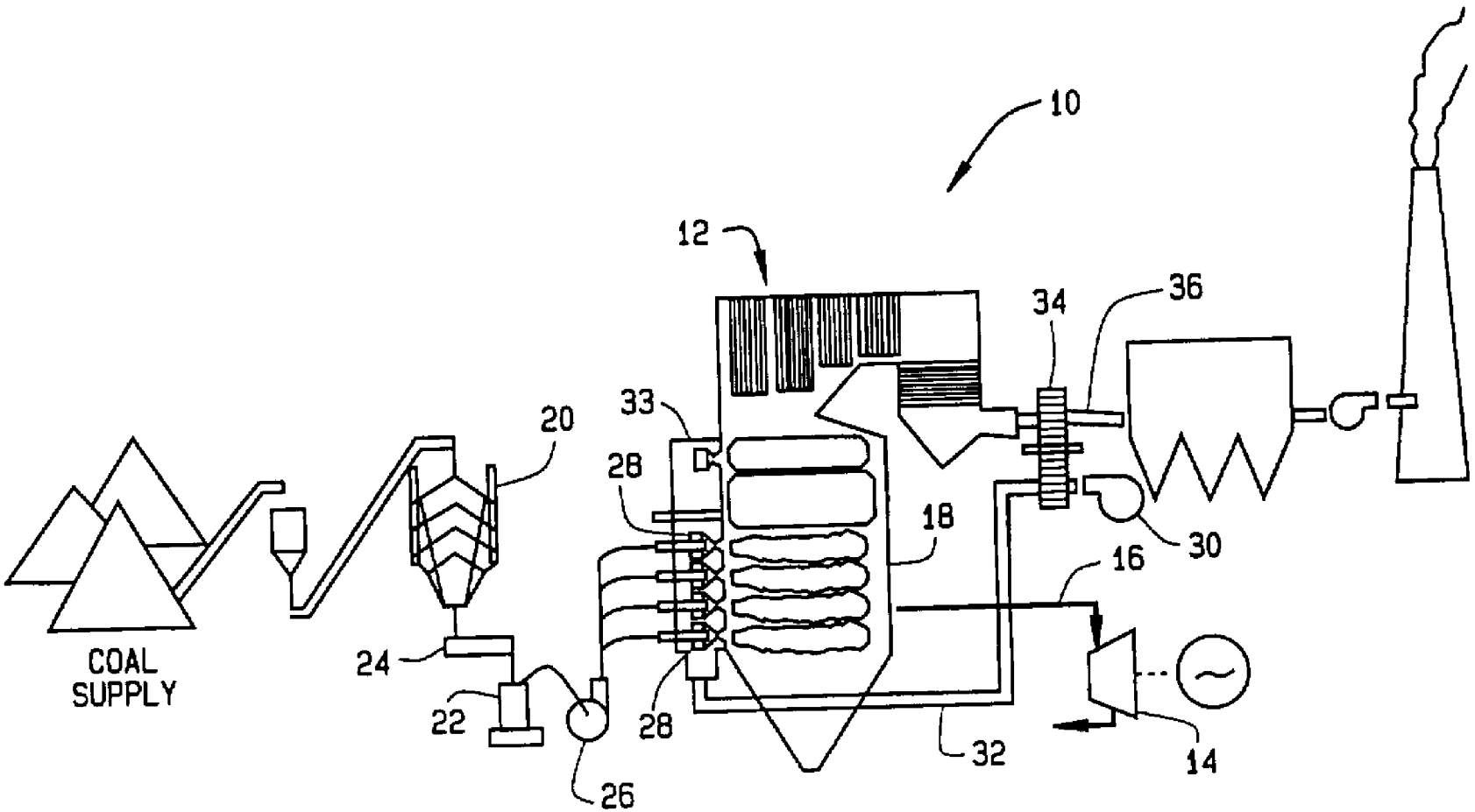
FIG. 1 is schematic view of a power generating system that includes a coal fired boiler.

Referring to the drawings, FIG. 1 is a schematic view of a power generating system 10 that includes, in an exemplary embodiment, a boiler 12 coupled to a steam turbine-generator 14. Steam is produced in boiler 12 and flows through steam pipe 16 to generator 14. Boiler 12 burns fossil fuel, for example, coal, in a boiler furnace 18 which produces heat to convert water into steam used to drive generator 14. Of course, in other embodiments the fossil fuel burned in boiler 12 can include oil or natural gas. Crushed coal is stored in a silo 20 and is further ground or pulverized into fine particulates by a pulverizer or mill 22. A coal feeder 24 adjusts the flow of coal from coal silo 20 into mill 22. An air source, for example, fan 26 is used to convey the coal particles to furnace 18 where the coal is burned by burners 28. The air used to convey the coal particles from mill 22 to burners 28 is referred to a primary air. A second fan 30 supplies secondary air to burners 28 through air conduit 32 and windbox 33. The secondary air is heated by passing through a regenerative heat exchanger 34 located in a boiler exhaust line 36.

Figure 2:
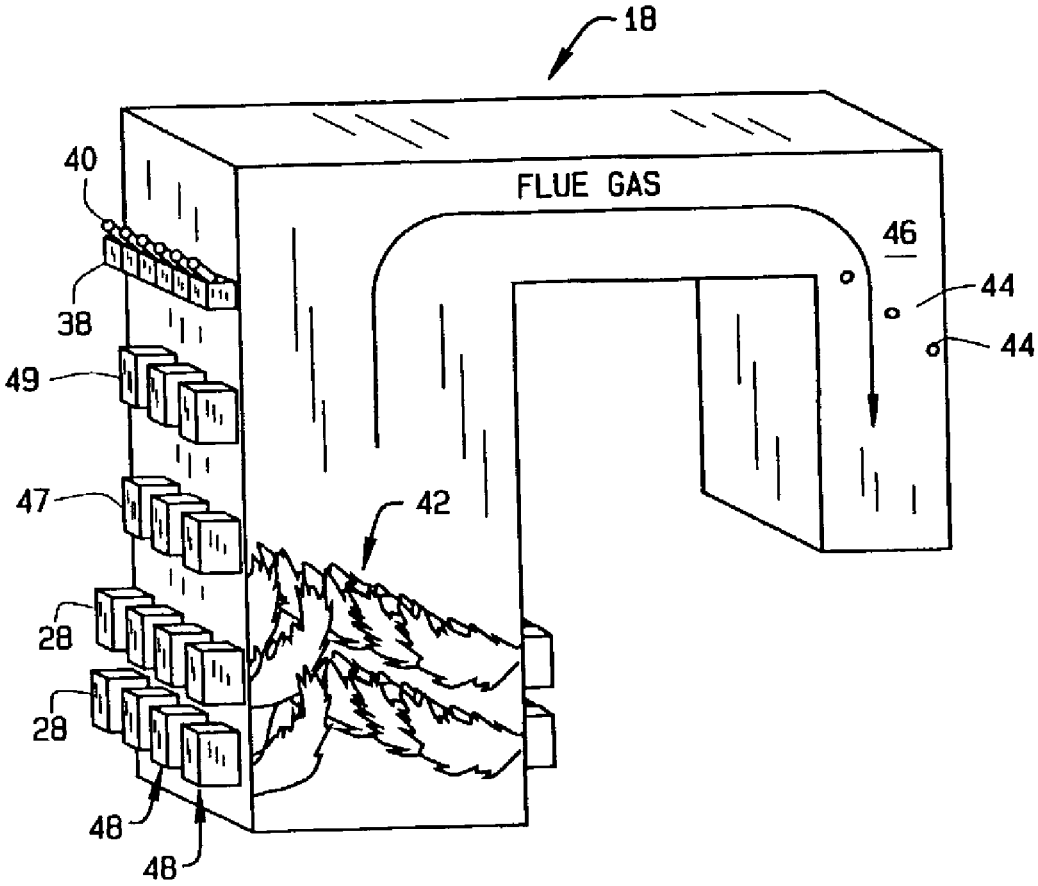
FIG. 2 is a schematic view of the boiler shown in FIG. 1.

Referring also to FIG. 2, boiler furnace 18 includes a plurality of LOI sensors 38 and a plurality of temperature sensors 40 in a grid formation and located downstream from a flame envelope 42 formed by burning coal in burners 28. A grid formation of a plurality of CO sensors 44 are located in an exit portion 46 of boiler furnace 18. The location of LOI sensors 38, temperature sensors 40, and CO sensors 44 in each grid correspond to burners 28 which are also in a grid arrangement For example, a LOI sensor 38, a temperature sensor 40, and a CO sensor 44 is located in alignment of each column 48 of burners 28. Of course, any suitable type of combustion quality indication sensor can be used to monitor the combustion process occurring in boiler furnace 18. Combustion quality indication sensors can include sensors that provide directly correlated and indirectly correlated (relative) measurements. Combustion quality indications can be obtained from absolute measurement, relative measurement, and drawing from analysis of fluctuations in combustion quality indicator sensor signals. Examples of combustion quality indicator sensors include, but are not limited to optical radiation sensors, LOI sensors, temperature sensors, CO sensors, $CO_2$ sensors, $NO_x$ sensors, $O_2$ sensors, total hydrocarbons (THC) sensors, volatile organic compounds (VOC) sensors, sulfur dioxide ($SO_2$) sensors, heat flux sensors, radiance sensors, opacity sensors, emissivity sensors, moisture sensors, hydroxyl radicals (OH) sensors, sulfur trioxide ($SO_3$) sensors, particulate matter sensors, and emission spectrum sensors. Also, boiler 18 includes a plurality of overfire air jets 47 and a plurality of reburn fuel jets 49.

Figure 3:
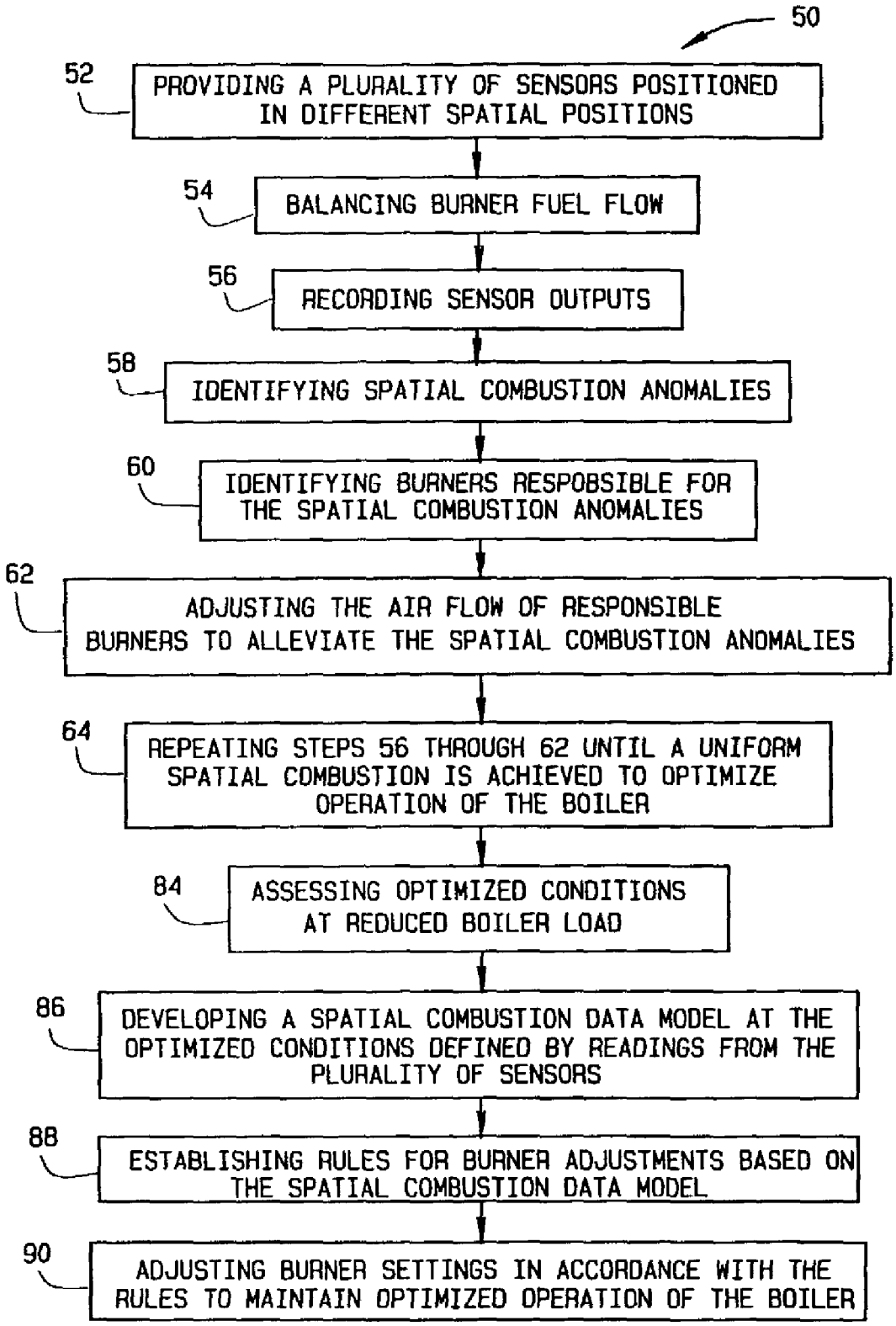
FIG. 3 is a flow chart of a method of optimizing fossil fuel fired boilers.

FIG. 3 is a flow chart of a method 50 of optimizing operation of boiler 12 that includes providing 52 a plurality of sensors positioned in different spatial positions within boiler 12, balancing 54 burner fuel flow, recording 56 sensor outputs, identifying 58 spatial combustion anomalies, identifying 60 burners responsible for the spatial combustion anomalies, and adjusting 62 the air flow of responsible burners to alleviate the spatial combustion anomalies. Method 50 also includes repeating 64 steps 56 through 62 until a uniform spatial combustion is achieved to optimize operation of boiler 12.

Figure 4:
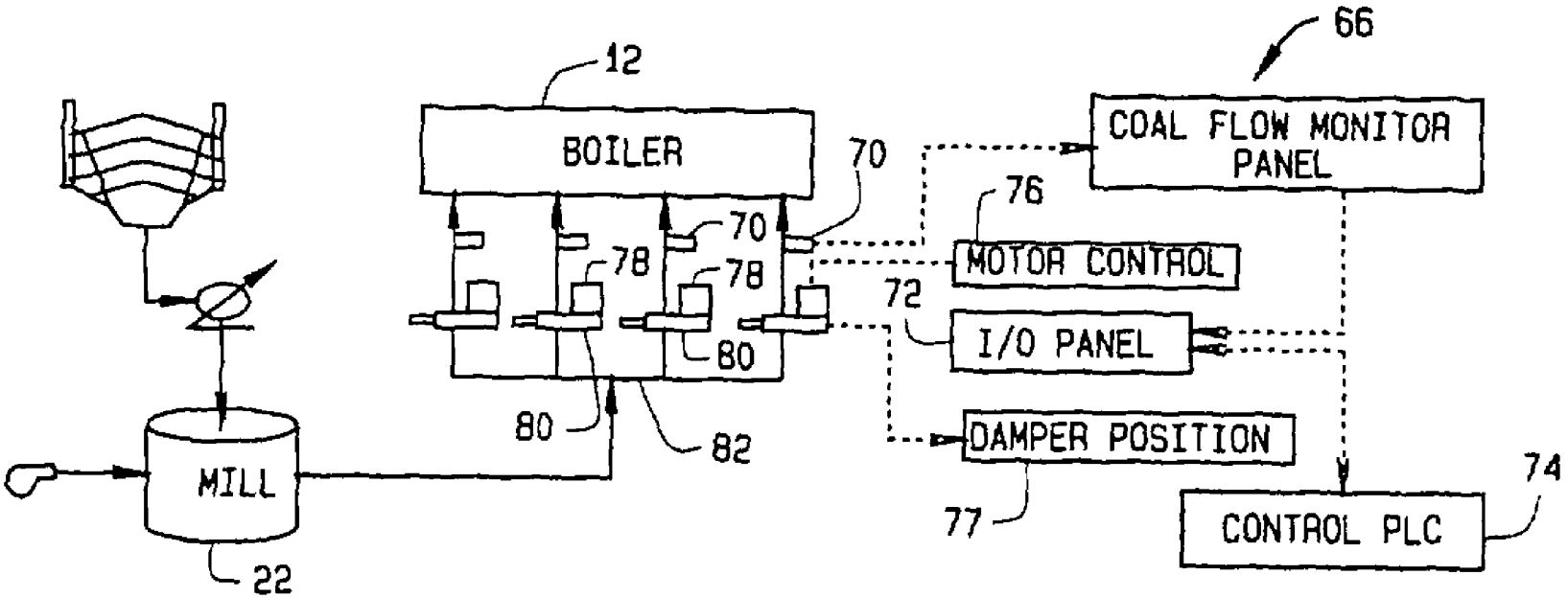
FIG. 4 is a schematic view of a portion of the system shown in FIG. 1.

To balance 54 burner fuel flow, the coal flow from mill 22 to burners 28 is balanced. Coal fineness, mill coal feeder, and mill primary air flow are variables that affect burner coal flow. Coal flow monitors and controls can be used to control coal flow. Referring to FIG. 4, a coal flow monitor system 66 includes a monitor panel 68 connected to and in communications with flow sensors 70 and an I/O panel 72 connected to and in communications with a PLC controller 74. A motor control 76 controls actuators 78 attached to dampers 80 in fuel input lines 82 coupled to mill 22 and boiler 12. Motor control 76 is connected to I/O panel 72. Damper position data 77 is also inputted into I/O panel 72. Sensors 70 monitor the coal flow from mill 22 to burners 28 (shown in FIG. 1) and PLC controller 74 sends signals to I/O panel 72 to adjust dampers 80 to adjust the coal flow to a predetermined rate.

To identify 58 spatial combustion anomalies, spatial combustion data from the plurality of CO sensors 44, LOI sensors 38, and temperature sensors 40 are examined. Also, a visual flame inspection is performed as well as examining input from any flame sensors to detect burner imbalance.

Identifying 60 burners responsible for the spatial combustion anomalies includes tracing burners 28 to corresponding sensors. Particularly, tracing the burners can be accomplished by computational flow modeling, isothermal flow modeling, and/or empirically by adjusting individual burner air settings and noting changes to sensor output data. The individual air settings can be adjusted by reducing excess air to individual burners and/or increasing fuel to individual burners to determine the burners that are causing the combustion anomalies. Also, settings to all burners can be adjusted by reducing excess air to all burners and/or increasing fuel to all burners to determine the burners that are causing the combustion anomalies. Also, settings to individual columns of burners can be adjusted by reducing excess air to individual columns of burners and/or increasing fuel to individual columns of burners to determine the burners that are causing the combustion anomalies. Further, increasing mill fuel flow at constant mill air flow and/or increasing mill fuel flow at a constant boiler air to fuel ratio can be used to determine the burners that are causing the combustion anomalies. Also, reducing windbox air flow at constant mill fuel flow, reducing windbox air flow at constant boiler fuel flow, and/or reducing windbox air flow at a constant boiler air to fuel ratio can be used to determine the burners that are causing the combustion anomalies.

Also, identifying responsible burners include recording burner settings, determining if anomalies trace to burners with most biased air settings, maximizing a feed air pressure drop at a mean damper setting, and adjusting burner air settings to alleviate combustion anomalies caused by the responsible burners.

Further, identifying responsible burners can include adjusting inner and outer spin vanes on individual burners and adjusting burner registers to determine responsible burners. Responsible burners are indicated where a small adjustment produces a large impact on burner combustion. Adjusting 62 responsible burner air flow to alleviate the spatial combustion anomalies also includes adjusting a secondary air damper and adjusting an over fire air damper.

Also, the air flow through overfire air jets and fuel flow through reburn fuel jets can cause combustion anomalies. Identifying responsible overfire jets responsible for spatial combustion anomalies can include reducing excess air to all burners and/or increasing fuel to all burners to determine overfire jets responsible for the spatial combustion anomalies. Identifying responsible reburn jets responsible for spatial combustion anomalies can include reducing excess air to all burners and/or increasing fuel to all burners to determine reburn jets responsible for the spatial combustion anomalies.

Referring again to FIG. 3, after optimizing spatial combustion parameters, Method 50 further includes assessing 84 optimized conditions at reduced boiler load by determining if burner fuel balance remains within acceptable parameters at reduced boiler load, determining if there are any other combustion anomalies, and determining burner and mill fuel set points as a function of load with burner air settings constant.

Method 50 also includes developing 86 a spatial combustion data model at the optimized conditions defined by readings from the plurality of sensors, establishing 88 rules for burner adjustments based on the spatial combustion data model, and adjusting 90 burner settings in accordance with the rules to maintain optimized operation of the boiler.

While the invention has been described in terms of various specific embodiments, those skilled in the art will recognize that the invention can be practiced with modification within the spirit and scope of the claims.

The invention claimed is:

1. A method of optimizing operation of a fossil fuel fired boiler, the boiler comprising a plurality of burners within a furnace, each burner receiving fossil fuel and combustion air, said method comprising:

(a) providing a first plurality of sensors within a combustion zone of the furnace, a second plurality of sensors within the furnace outside the combustion zone and upstream from a heat exchanger, and a third plurality of sensors within the furnace outside the combustion zone, wherein the third plurality of sensors are upstream from the heat exchanger and downstream from the first and second plurality of sensors, and wherein the first plurality of sensors, the second plurality of sensors, and the third plurality of sensors are positioned to correspond to the plurality of burners;

(b) recording sensor outputs;

(c) identifying spatial combustion anomalies indicated by the sensor outputs;

(d) identifying a plurality of flow paths from each of the plurality of burners to corresponding ones of the plurality of sensors using flow modeling, and identifying burners responsible for the spatial combustion anomalies based on the plurality of flow paths;

(e) adjusting air flow of responsible burners to alleviate the spatial combustion anomalies to facilitate at least one of reducing NOx emissions, reducing LOI emissions, increasing efficiency, increasing power input, improving superheat temperature profile, and reducing opacity, wherein adjusting air flow of responsible burners comprises at least one of reducing excess air to at least some burners and increasing fuel to at least some burners to determine the burners causing the combustion anomalies; and (f) providing a plurality of dampers coupled to fuel input lines to adjust fuel flow to the burners based on the sensor outputs.

2. A method in accordance with claim 1 further comprising balancing burner fuel flow.

3. A method in accordance with claim 2 wherein balancing burner fuel flow comprises adjusting burner air flow and then adjusting burner fuel flow.

4. A method in accordance with claim 2 wherein balancing burner fuel flow comprises adjusting burner fuel flow and then adjusting burner air flow.

5. A method in accordance with claim 1 further comprising repeating (b) through (e) until a uniform spatial combustion is achieved to optimize operation of the boiler.

6. A method in accordance with claim 2 wherein the boiler further comprises at least one fuel mill, and balancing burner fuel flow further comprises:

monitoring and adjusting mill fuel flow; and monitoring and adjusting burner fuel flow.

7. A method in accordance with claim 1 wherein identifying spatial combustion anomalies further comprises examining spatial combustion data from the first plurality of sensors, the second plurality of sensors, and the third plurality of sensors.

8. A method in accordance with claim 1 wherein identifying a plurality of flow paths from each of the plurality of burners comprises tracing the burners to corresponding sensors using at least one of computational flow modeling and isothermal flow modeling.

9. A method in accordance with claim 1 wherein adjusting responsible burner air flow to alleviate the spatial combustion anomalies comprises at least one of reducing excess air to all burners and increasing fuel to all burners to determine the burners that are causing the combustion anomalies.

10. A method in accordance with claim 1 wherein adjusting responsible burner air flow to alleviate the spatial combustion anomalies comprises at least one of reducing excess air to individual groups of burners and increasing fuel to individual groups of burners to determine the burners that are causing the combustion anomalies.

11. A method in accordance with claim 6 wherein adjusting responsible burner air flow to alleviate the spatial combustion anomalies comprises at least one of increasing mill fuel flow at constant mill air flow, increasing mill fuel flow at constant boiler air, and increasing mill fuel flow at a constant boiler air to fuel ratio to determine the burners that are causing the combustion anomalies.

12. A method in accordance with claim 6 wherein the boiler further comprises a windbox, and wherein adjusting responsible burner air flow to alleviate the spatial combustion anomalies comprises at least one of reducing windbox air flow at constant mill fuel flow, reducing windbox air flow at constant boiler fuel flow, and reducing windbox air flow at a constant boiler air to fuel ratio to determine the burners that are causing the combustion anomalies.

13. A method in accordance with claim 1 wherein adjusting responsible burner air flow to alleviate the spatial combustion anomalies further comprises:

recording burner settings;

determining if anomalies trace to burners with most biased air settings;

maximizing a feed air pressure drop at a mean damper setting; and adjusting burner air settings to alleviate combustion anomalies caused by responsible burners.

14. A method in accordance with claim 13 wherein each burner comprises an inner and an outer spin vane, burner registers, and adjusting burner air settings to alleviate the spatial combustion anomalies comprises:

adjusting inner and outer spin vanes on individual burners; and adjusting burner registers to determine responsible burners.

15. A method in accordance with claim 14 wherein adjusting responsible burner air flow to alleviate the spatial combustion anomalies comprises:

adjusting a secondary air damper; and adjusting an over fire air damper.

16. A method in accordance with claim 6 further comprising:

reducing a boiler load;

determining if burner fuel balance remains within acceptable parameters at reduced boiler load;

determining if there are any other combustion anomalies; and determining burner and mill fuel set points as a function of load with burner air settings constant.

17. A method in accordance with claim 1 further comprising developing a spatial combustion data model at the optimized conditions defined by readings from the first plurality of sensors, the second plurality of sensors, and the third plurality of sensors.

18. A method in accordance with claim 17 further comprising:

establishing rules for burner adjustments based on the spatial combustion data model; and adjusting burner settings in accordance with the rules to maintain optimized operation of the boiler.

19. A method in accordance with claim 1 wherein each of the first plurality of sensors, the second plurality of sensors, and the third plurality of sensors comprises at least one of optical radiation sensors, LOI sensors, temperature sensors, CO sensors, CO2 sensors, NOx sensors, O2 sensors, total hydrocarbons sensors, volatile organic compounds sensors, sulfur dioxide sensors, heat flux sensors, radiance sensors, opacity sensors, emissivity sensors, moisture sensors, hydroxyl radicals sensors, sulfur trioxide sensors, particulate matter sensors, and emission spectrum sensors.

20. A method in accordance with claim 1 wherein at least one of the first plurality of sensors, the second plurality of sensors, and the third plurality of sensors comprises at least one of a CO sensor and an O2 sensor.

21. A method in accordance with claim 1 wherein at least one of the first plurality of sensors, the second plurality of sensors, and the third plurality of sensors comprises at least one of a CO2 sensor and an O2 sensor.

* * * * *